US007728240B2

(12) United States Patent
Dodal et al.

(10) Patent No.: US 7,728,240 B2
(45) Date of Patent: Jun. 1, 2010

(54) ELECTRICAL CONTROL DEVICE

(75) Inventors: Rohit Dodal, Peachtree City, GA (US); Feihong Chen, Langxi Town (CN)

(73) Assignee: Cooper Technologies Company, Houston, TX (US)

( * ) Notice: Subject to any disclaimer, the term of this patent is extended or adjusted under 35 U.S.C. 154(b) by 132 days.

(21) Appl. No.: 11/983,278

(22) Filed: Nov. 8, 2007

(65) Prior Publication Data

US 2009/0121661 A1 May 14, 2009

(51) Int. Cl.
*H01H 1/36* (2006.01)

(52) U.S. Cl. ..... 200/252; 200/329

(58) Field of Classification Search ..... 200/16 R–16 D, 200/329, 547–550, 252
See application file for complete search history.

(56) References Cited

U.S. PATENT DOCUMENTS

| | | | | |
|---|---|---|---|---|
| 2,203,555 | A | 6/1940 | Von Hoorn | |
| 2,648,808 | A | 8/1953 | Tiede | |
| 2,903,633 | A | 9/1959 | Cother | |
| 3,350,521 | A | 10/1967 | Brown | |
| 3,355,565 | A * | 11/1967 | Daul | 200/548 |
| 3,485,966 | A | 12/1969 | Bailey et al. | |
| 3,581,033 | A | 5/1971 | Plumb | |
| 3,598,943 | A | 8/1971 | Barrett | |
| 3,641,291 | A | 2/1972 | Carling | |
| 3,746,359 | A | 7/1973 | Lewis | |
| 3,772,484 | A | 11/1973 | Roeser | |
| 3,778,577 | A | 12/1973 | Fromknecht et al. | |
| 3,857,000 | A | 12/1974 | Boulanger | |
| 3,983,355 | A | 9/1976 | Hyodo | |
| 4,152,565 | A * | 5/1979 | Rose | 200/548 |
| 4,311,885 | A | 1/1982 | Arthur | |
| 4,345,121 | A | 8/1982 | Tenner | |
| 4,383,155 | A | 5/1983 | Tenner | |
| 4,401,872 | A | 8/1983 | Boichot-Castagne et al. | |
| 4,408,105 | A | 10/1983 | Tanaka | |
| 4,408,150 | A | 10/1983 | Holston et al. | |
| 4,429,202 | A | 1/1984 | Tedd et al. | |
| 4,465,956 | A | 8/1984 | Fowler | |
| 4,492,828 | A | 1/1985 | Martinez et al. | |
| 4,520,306 | A | 5/1985 | Kirby | |
| 4,686,339 | A | 8/1987 | Sapone | |
| 4,710,600 | A | 12/1987 | Sasaki et al. | |
| 4,767,895 | A | 8/1988 | Parrish | |
| 4,778,964 | A | 10/1988 | Kamisada | |
| 4,871,885 | A * | 10/1989 | Kamada | 200/5 R |
| 5,293,103 | A | 3/1994 | Hanna | |
| 5,543,595 | A | 8/1996 | Mader et al. | |
| 6,166,344 | A | 12/2000 | Castonguay et al. | |
| 6,891,117 | B1 | 5/2005 | Gouhl et al. | |
| 6,943,309 | B2 | 9/2005 | Huang | |
| 7,466,843 | B2 * | 12/2008 | Pryor | 382/103 |
| 7,518,078 | B1 | 4/2009 | Dodal et al. | |
| 7,595,460 | B1 | 9/2009 | Dodal et al. | |

OTHER PUBLICATIONS

U.S Appl. No. 11/689,300, Dodal et al.
U.S Appl. No. 11/689,309, Dodal et al.
U.S Appl. No. 11/689,292, Dodal et al.
U.S Appl. No. 11/689,284, Dodal et al.

* cited by examiner

*Primary Examiner*—Renee S Luebke
*Assistant Examiner*—Lisa Klaus
(74) *Attorney, Agent, or Firm*—King & Spalding LLP

(57) ABSTRACT

An electrical control device is described.

20 Claims, 9 Drawing Sheets

ELECTRICAL CONTROL DEVICE

BACKGROUND

The present disclosure generally relates to an electrical control device configured to control one or more other devices, such as one or more fans.

BRIEF SUMMARY OF THE INVENTION

An electrical control device includes an elongated member that includes a plurality of substantially collinear detents on a first side thereof. The detents are disposed along a longitudinal axis of the first side of the elongated member. A slider is coupled to the elongated member and is slidable along the longitudinal axis of the elongated member. A knob is coupled to a first side of the slider. A positioning member is coupled to a second side of the slider. The second side of the slider is disposed opposite the first side of the slider. The positioning member engages the first side of the elongated member and is positionable along the first side of the elongated member in conjunction with the slider. A spring is disposed substantially between the positioning member and the second side of the slider. A connector is coupled to the second side of the slider and includes at least one contact that engages a stationary contact of a printed circuit board when the positioning member is at least partially disposed within one of the detents of the elongated member. An axis parallel to an axis of compression of the spring intersects each of the slider, the knob, and the positioning member. For example, the axis of compression of the spring can intersect each of the slider, the knob, and the positioning member.

DETAILED DESCRIPTION

The following description of exemplary embodiments refers to the attached drawings, in which like numerals indicate like elements throughout the several figures.

Figure 1:
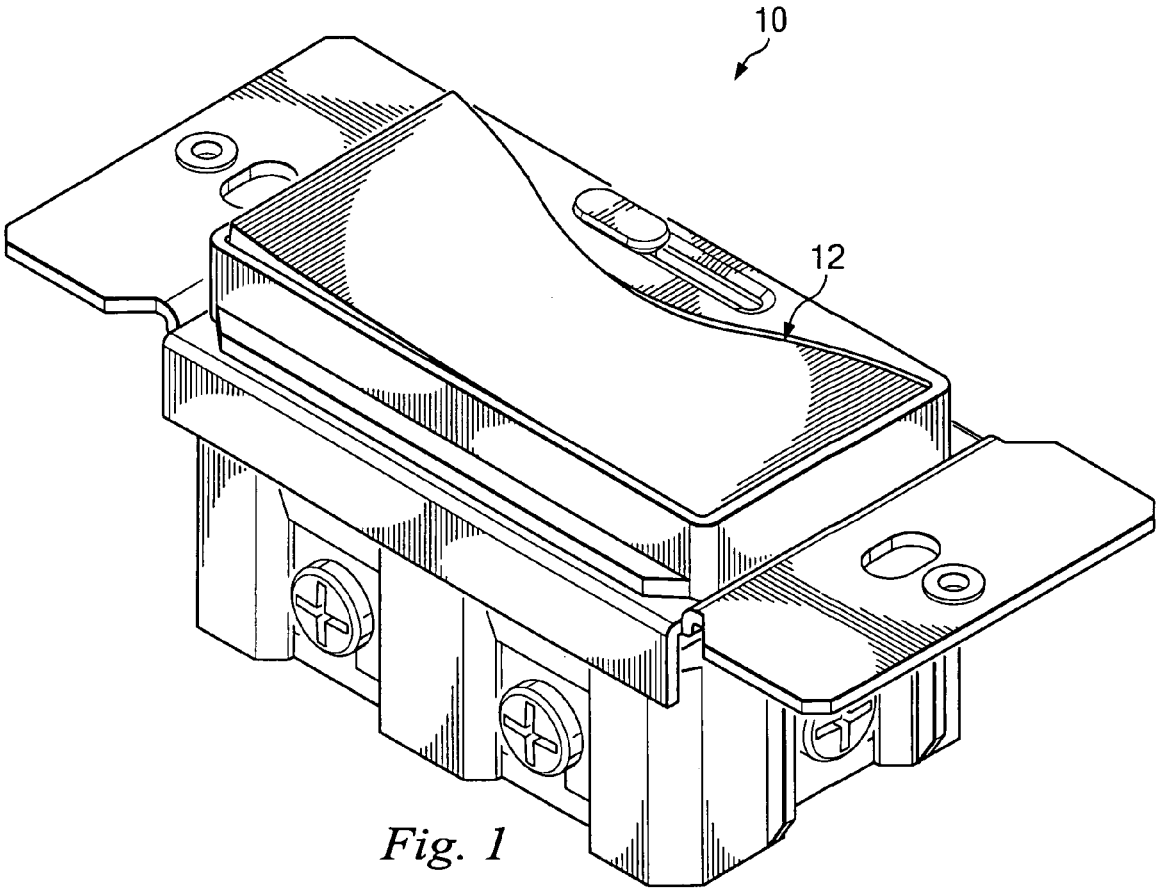
FIG. 1 is a perspective view of an exemplary electrical control device, in accordance with certain exemplary embodiments.

FIG. 1 is a perspective view of an exemplary electrical control device 10, in accordance with certain exemplary embodiments. The device 10 will be described in further detail with reference to FIGS. 2-17.

Figure 2:
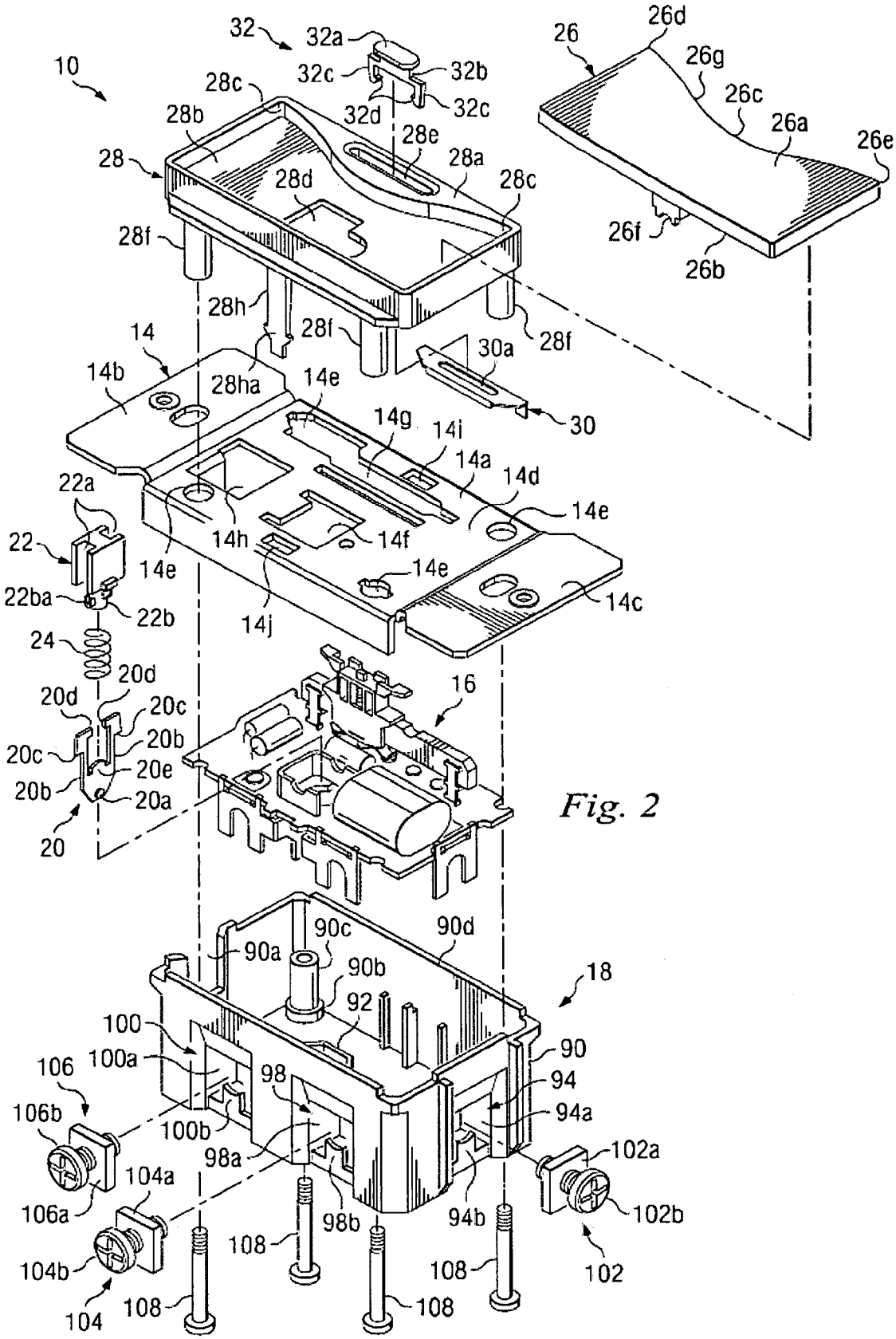
FIG. 2 is a partially exploded/partially unexploded view of an exemplary electrical control device, in accordance with certain exemplary embodiments.

FIG. 2 is a partially exploded/partially unexploded view of the device 10, in accordance with certain exemplary embodiments. As illustrated in FIG. 2, the device 10 includes a mounting plate 14, a printed circuit assembly 16, and a switch housing assembly 18. The device 10 also includes an actuator assembly 12, which is illustrated in its assembled configuration in FIG. 3.

Figure 3:
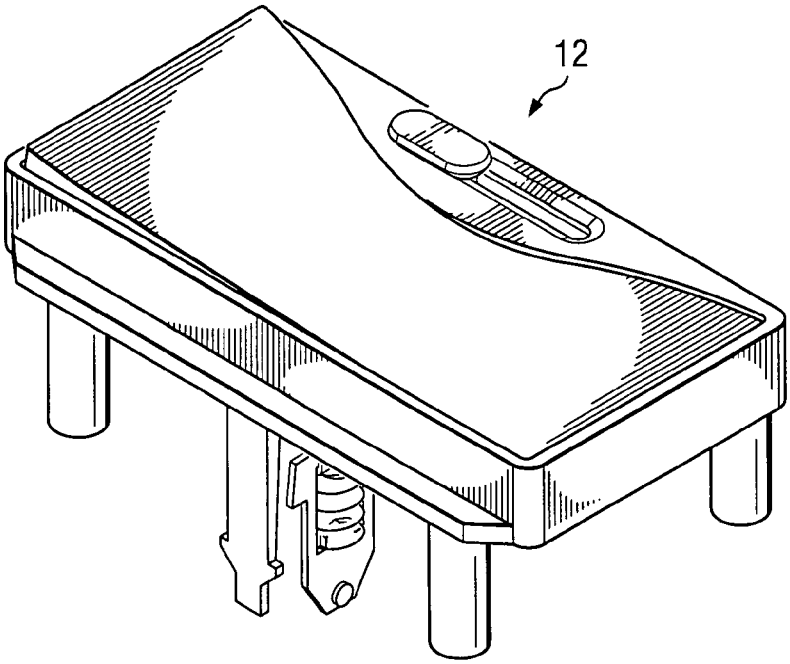
FIG. 3 is a perspective view of an exemplary actuator assembly of an exemplary electrical control device, in accordance with certain exemplary embodiments.

With reference to FIGS. 2 and 3, the actuator assembly 12 will be described. FIG. 3 is a perspective view of the exemplary actuator assembly 12 of the exemplary electrical control device 10, in accordance with certain exemplary embodiments. As illustrated in FIGS. 2 and 3, the actuator assembly 12 includes a flipper 20, an actuator 22, an actuator spring 24, a rocker 26, an actuator mount 28, a knob guide 30, and a selector knob 32. The flipper 20 is substantially U-shaped and includes a flipper contact 20*a* in an arcuate section of the flipper 20. Spaced, parallel members 20*b* extend away from the flipper contact 20*a* and widen to create shoulders 20*c* proximate the end of the members 20*b*. A pair of opposing protrusions 20*d* extends toward each other from the ends of the members 20*b*. A short protrusion 20*e* extends from the interior of the arcuate section of the flipper 20 in a direction parallel to the members 20*b* and has a width substantially similar to an interior diameter of the actuator spring 24.

The actuator 22 is generally cube-shaped and is adapted to engage the rocker 26. The actuator 22 includes a pair of retaining notches 22*a* for receiving the shoulders 20*c* of the flipper 20 and a protrusion 22*b* that has a notch 22*ba* on its end face for receiving the actuator spring 24. The actuator spring 24 is a coil spring the free length of which is longer than the distance between an interior edge of the arcuate section of the flipper 20 and the widened portions of the members 20*b*. The spring 24 can include a crosspiece, not shown, extending across an end thereof with a length generally equal to the diameter of the spring 24.

The rocker has a generally rectangular front face 26*a* and a generally rectangular rear face 26*b*. A right-hand edge 26*g* of the rocker 26 curves towards the center of the rocker 26 and forms a crescent-shaped indentation 26*c* in the right-hand side of the rocker 26. A pair of protrusions 26*d* and 26*e* extend from the left- and right-hand sides, respectively, of the rocker 26. The rear face 26*b* of the rocker 26 includes a receptacle 26*f* shaped and sized to receive the actuator 22. A top rocker end comprises the top portion of the rocker 26 that is located above a rotational axis defined by the protrusions 26*d* and 26*e*. A bottom rocker end comprises the bottom portion of the rocker 26 that is located hereinafter the protrusions 26*d* and 26*e*.

The actuator mount 28 has a front face 28*a* with a recess 28*b* into which the rocker 26 is adapted to be disposed. The recess 28*b* is shaped substantially like the rocker 26 and the depth of the recess 28*b* is such that, when then rocker 26 is actuated and one end thereof is pressed fully into the recess 28*b*, the front face 26*a* of the depressed end of the rocker 26 will be substantially flush with the face 28*a* of the actuator mount 28. The actuator mount 28 further includes a pair of openings 28*c* located opposite one another in the sidewalls defined by the recess 28*b* and configured to receive the protrusions 26*d*, 26*e* of the rocker 26. The actuator mount 28 also includes an actuator pass-through 28*d* centrally located in a front face 28*b* a of the recess 28*b*. A vertical knob slot 28*e* is located adjacent the recess 28*b* and runs generally parallel with the right-hand edge of the actuator mount 28.

The actuator mount 28 includes four assembly protrusions 28*f*. Each assembly protrusion 28*f* has a threaded interior and extends rearward from a corner of a rear face 28*g* of the actuator mount 28. A pair of tabs 28*h*, shown in FIG. 2, the distal ends of which feature a broadened head 28*ha*, extends from the side edges of the rear face 28*g* of the actuator mount 28 in a direction similar to the direction of extension of the assembly protrusions 28*f*.

In certain exemplary embodiments, actuator mount 28 can further include a padded material, not shown, disposed at the distal ends of the face 28*ba* of the recess 28*b*, where the ends of the rocker 26 would otherwise strike the face 28*ba* when the rocker 26 is actuated. The padded material can help cushion the rocker 26 and the actuator mount 28 when the rocker 26 is actuated.

The knob guide 30 includes a slot 30*a* that is generally the same width as the knob slot 28*e*. The selector knob 32 comprises a head 32*a* attached to a crosspiece 32*b*, to which are attached a set of spaced parallel connection members 32*c* that extend away from the underside of the head and which are tipped by a pair of protrusions 32*d* that are directed toward each other in the interior space between the connection members 32*c*. The connection members 32*c* are at least slightly narrower than the width of the knob slot 28*e* and the slot 30*a* of the knob guide 30.

The rocker 26 is disposed in the recess 28*b* of the actuator mount 28 and is hingedly coupled to the actuator mount 28 by the extension of the protrusions 26*d* and 26*e* into their respective openings 28*c*. The actuator receptacle 26*f* extends through the actuator pass-through 28*d* of the actuator mount 28 and receives the actuator 22.

The knob guide 30 is disposed directly beneath the knob slot 28*e* so that the slot 30*a* of the knob guide 30 aligns with the knob slot 28*e*. The selection knob 32 is inserted into the actuator mount 28 so that the crosspiece 32*b* and connection members 32*c* of the selection knob 32 extend through both the knob slot 28*e* and the slot 30*a* of the knob guide 30 and the bottom of the knob head 32*a* is substantially flush with the face 28*a* of the actuator mount 28.

The mounting plate 14 includes a main body 14*a* from which attachment tabs 14*b* and 14*c* extend. The attachment tabs 14*b* and 14*c* are generally parallel to a front face 14*d* of the main body 14*a*. Four assembly pass-throughs 14*e* are located, one each, generally in the four corners of the front face 14*d* of the main body 14*a* and are spaced so as to align with the assembly protrusions 28*f* when the actuator mount 28 is properly aligned over the mounting plate 14. Similarly, an actuator pass-through 14*f* and a slider pass-through 14*g* are located so that they align with the actuator pass-through 28*d* and the knob slot 28*e*, respectively, when the assembly protrusions 28*f* are aligned with the assembly pass-throughs 14*e*, respectively.

Grounding terminal 14*h* extends downward from the main body 14*a*, near the junction between the main body 14*a* and the attachment tab 14*b*, in a direction perpendicular to the plane of the mounting plate 14. A pair of assembly tab pass-throughs 14*i* is located generally midway between the attachment tabs 14*b* and 14*c*, one each of the pass-throughs 14*i* being located near the left- and right-side edges of the main body 14*a*, respectively.

Figure 5:
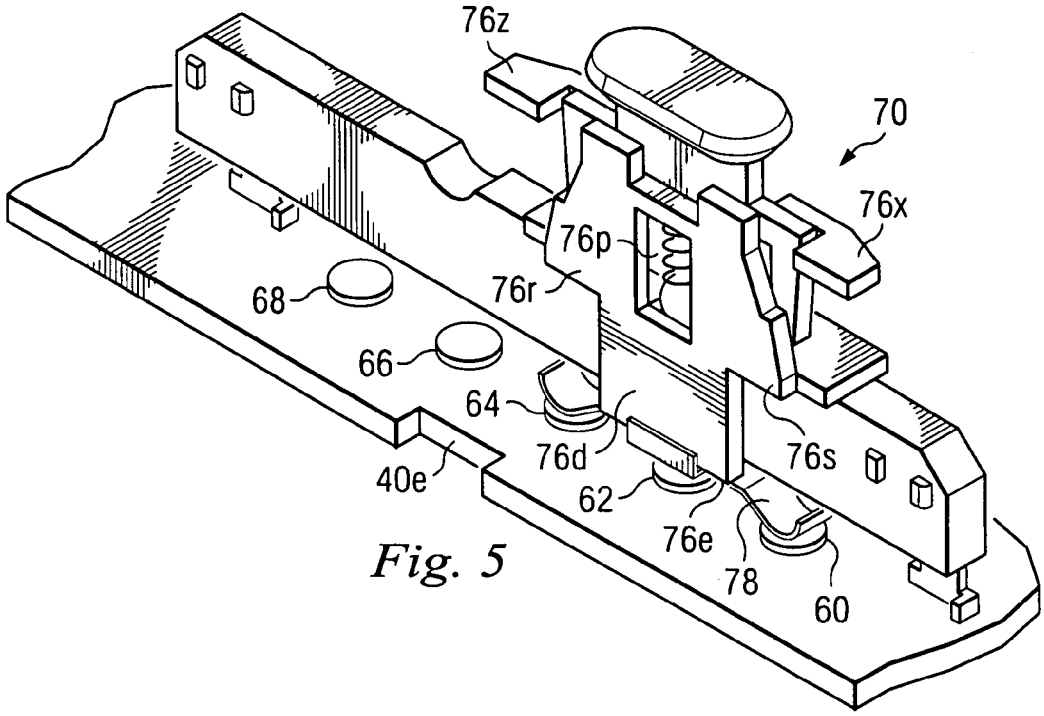
FIG. 5 is a perspective view of an exemplary slider assembly of an exemplary electrical control device, in accordance with certain exemplary embodiments.
Figure 4:
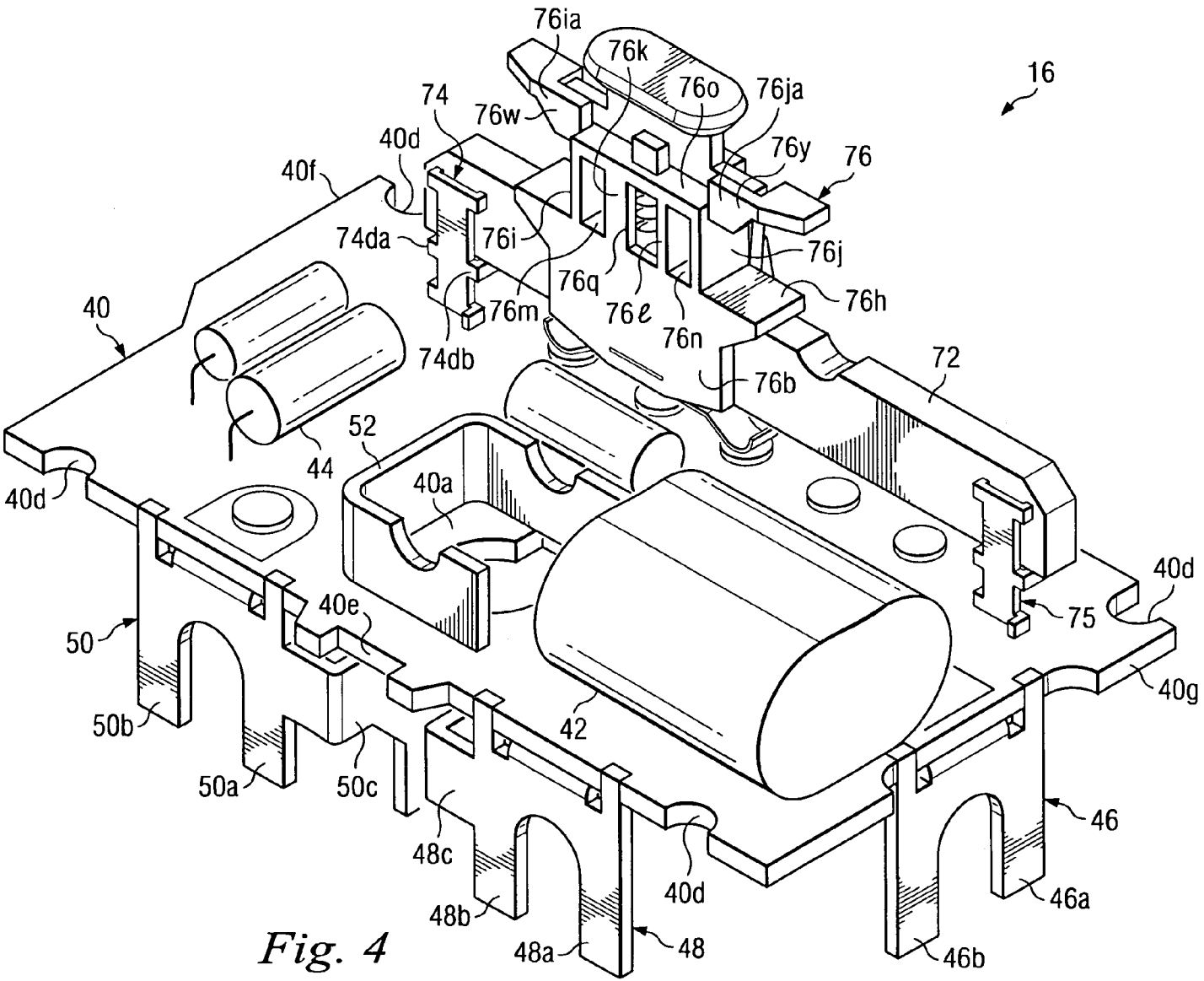
FIG. 4 is a perspective view of an exemplary printed circuit assembly of an exemplary electrical control device, in accordance with certain exemplary embodiments.
Figure 6:
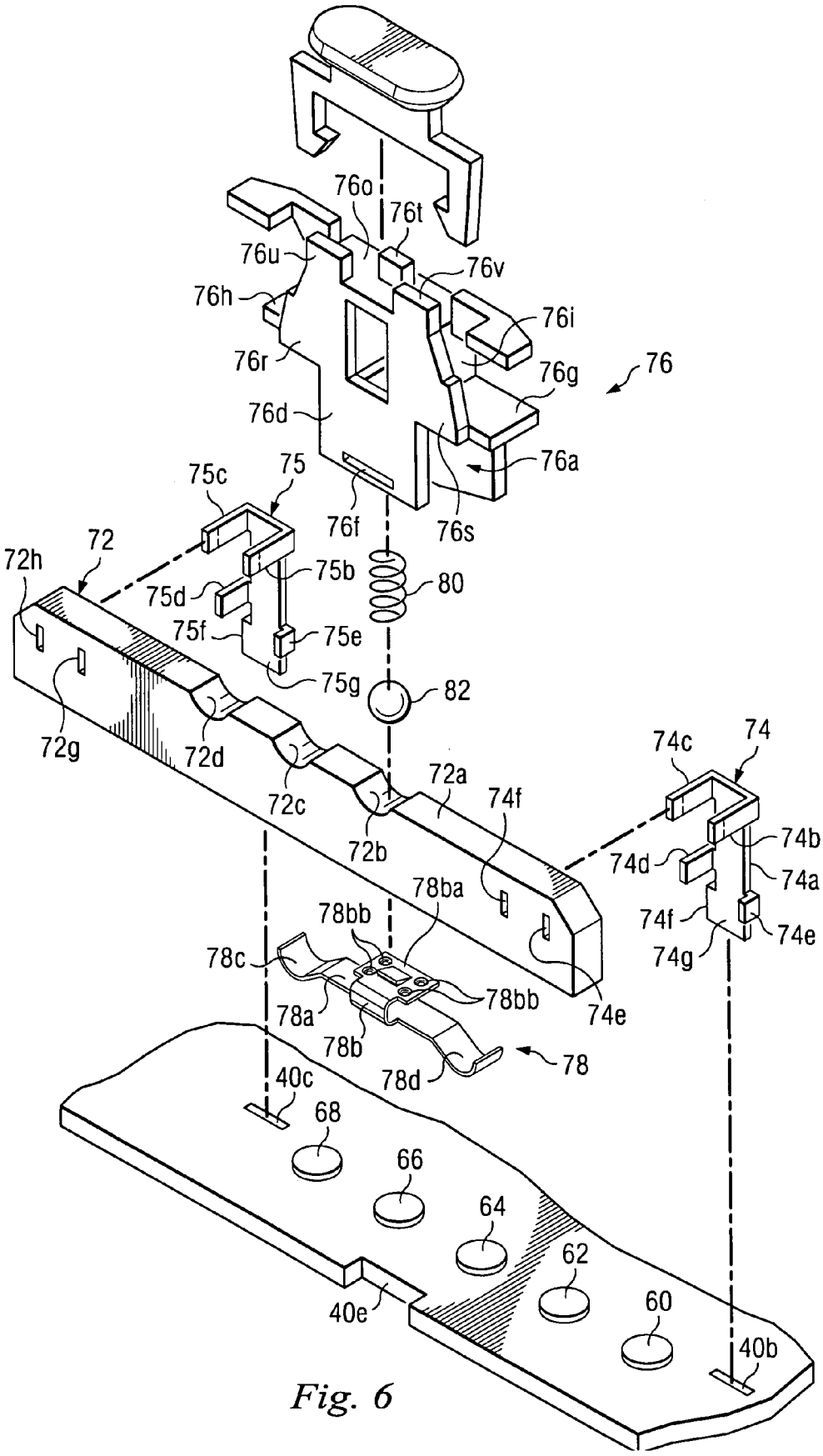
FIG. 6 is an exploded view of an exemplary slider assembly of an exemplary electrical control device, in accordance with certain exemplary embodiments.

With reference to FIGS. 2-6, the printed circuit assembly 16 of the device 10 will be described. FIG. 4 is a perspective view of the printed circuit assembly 16, in accordance with certain exemplary embodiments. FIG. 5 is a perspective view of an exemplary slider assembly 70 the printed circuit assembly 16, in accordance with certain exemplary embodiments, and FIG. 6 is an exploded view of the exemplary slider assembly 70, in accordance with certain exemplary embodiments.

The printed circuit assembly 16 includes a printed circuit board ("PCB") 40 that includes a flipper pass-through 40*a*, two sets of slide rail support slits 40*b* and 40*c*, a set of four assembly pass-throughs 40*d*, and a pair of assembly notches 40*e* on the left and right sides of the PCB 40. The printed circuit assembly 16 includes a device circuit having various electrical components, such as capacitors 42, resistors 44, a line terminal 46, load terminals 48 and 50, flipper cradle 52, and stationary contacts 60, 62, 64, 66 and 68, all of which are coupled to the PCB 40. The device circuit is described in more detail hereinafter with reference to FIG. 7.

The flipper pass-through 40*a* is located on the left side of the PCB 40 such that if the actuator mount 28 was placed over the front face 40*f* of the PCB 40 the flipper pass-through 40*a* would communicate with the actuator pass-through 28*d*. The flipper cradle 52 is disposed around the flipper pass-through 40*a* on the front face 40*f*.

The stationary contacts 60, 62, 64, 66 and 68, which are circular and feature a slightly dome-shaped top, are arrayed in an equally spaced, collinear formation running parallel to and near the right edge of the front face 40*f*. The stationary contacts 60, 62, 64, 66 and 68 are located such that if the actuator mount 28 was placed over the front face 40*f* of the PCB 40, the array of the contacts 60, 62, 64, 66, and 68 would be aligned with the knob slot 28*e*.

The two sets of slide rail support slits 40*b* and 40*c* are located on the front face 40*f*, just past the top and bottom ends, respectively, of the array of the stationary contacts 60, 62, 64, 66, and 68.

The pass-through notches 40*d*, which have a generally arcuate shape, are located on the side edges of the PCB 40 and are offset slightly from the corners of the PCB 40. Two assembly notches 40*e* are located near the centers of the left and right edges of the PCB 40 and have a width substantially similar to that of the assembly protrusions 28*f*.

Figure 7:
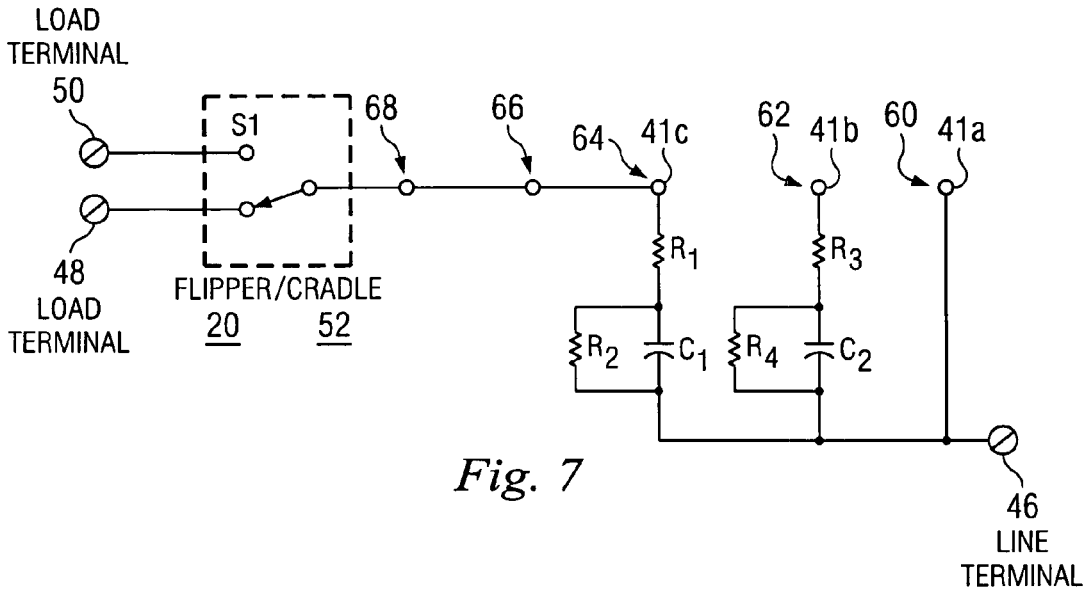
FIG. 7 is a circuit diagram illustrating an exemplary circuit of an exemplary electrical control device, in accordance with certain exemplary embodiments.

FIG. 7 illustrates an exemplary circuit diagram of the device circuit 41, in accordance with certain exemplary embodiments. Within the device circuit 41, the line terminal 46 is directly electrically coupled to the stationary contacts 60, 62 and 64 via circuit pathways 41*a*, 41*b*, and 41*c*, respectively. The stationary contact 64 is further electronically coupled to the stationary contacts 66 and 68 and the flipper cradle 52 in series. The line terminal 46 is therefore also electronically coupled to the flipper cradle 52 via the pathway 41*c*. In terms of circuit analysis, the pathway 41*c* provides the only means by which voltage may be supplied between the flipper cradle 52 and the line terminal 46 when the pathways of the device circuit 41 are laid out as illustrated in FIG. 7.

The line terminal 46 extends from the bottom edge of a rear face 40*g* of the PCB 40 in a direction perpendicular the rear face 40*g* and includes a pair of spaced parallel contact members 46*a* and 46*b*. The load terminals 48 and 50 extend from the left edge of the rear face 40*g* in a direction perpendicular the rear face 40*g* and include pairs of spaced parallel contact members 48*a* and 48*b* and 50*a* and 50*b*, respectively. Load terminal 50 is located on the upper portion of the left edge of the PCB 40 and load terminal 48 is located on the lower portion of the left edge of the PCB 40. Terminal contacts 48*c* and 50*c* extend first laterally toward each other and then turn 90 degrees to extend toward the space behind the flipper pass-through 40*a*. The terminal contacts 48*c* and 50*c* face each other generally on opposite sides of the flipper pass-through 40*a* on the rear face 40*g*.

The printed circuit assembly 16 further includes the slider assembly 70 that can be selectively electrically coupled with certain other components of the printed circuit assembly 16. The slider assembly 70 is illustrated in more detail in FIGS. 4-6. The slider assembly 70 includes a slide rail 72, slide rail supports 74 and 75, a slider 76, a slider connector 78, a spring 80 and a ball 82. The slide rail 72 is a generally horizontal member having a generally rectangular cross-section, the longer sides of which are on the vertical. The generally flat top surface 72*a* of the slide rail 72 includes detents 72*b*, 72*c*, and 72*d*, which are equidistant from each other and collectively centered on the surface 72*a* of the slide rail.

A pair of spaced parallel slits 72*e* and 72*f*, which are oriented perpendicular the surface 72*a*, are located on the side of the slide rail 72 near one end and extend therethrough. An identical pair of slits 72*g* and 72*h* is located at the opposite end of the slide rail 72.

Figure 8:
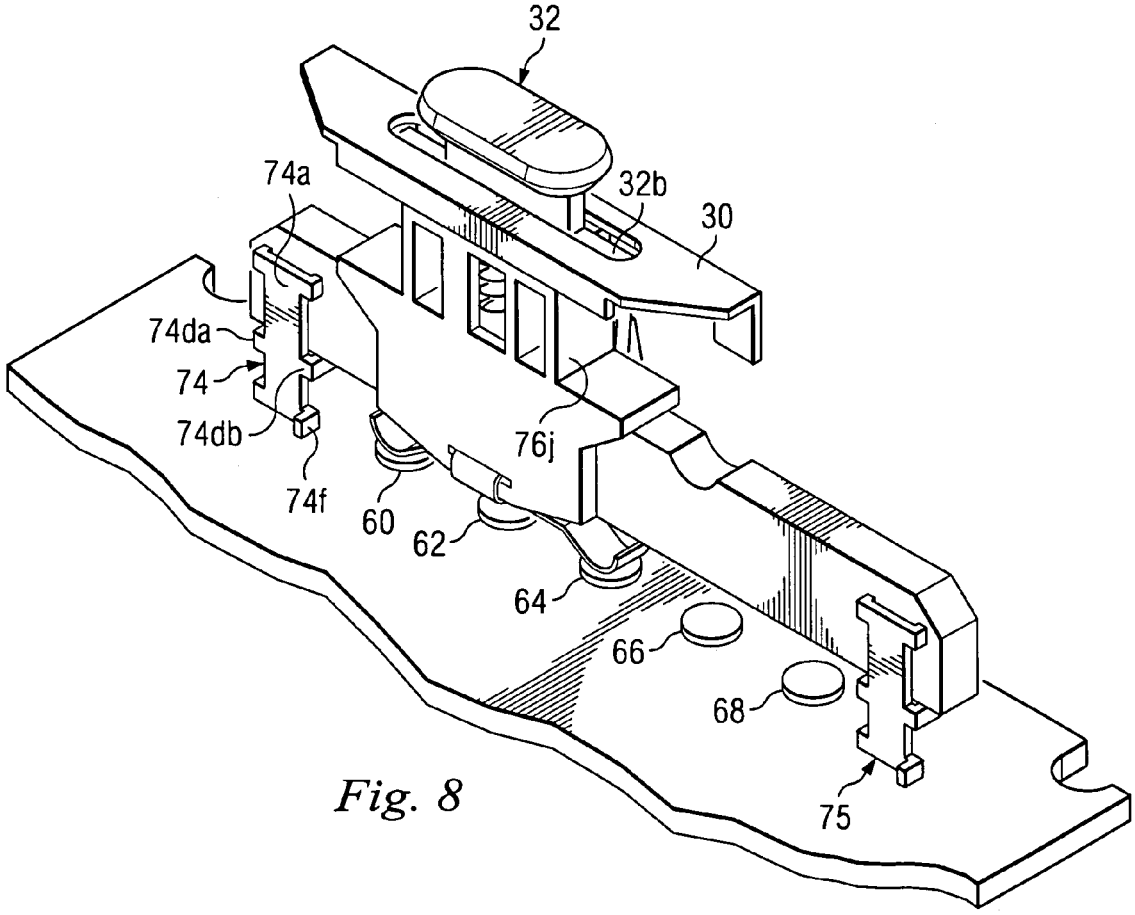
FIG. 8 is a perspective view of an exemplary assembly of an exemplary selector knob, an exemplary knob guide, and an exemplary slider, in accordance with certain exemplary embodiments.

The slide rail support 74 includes a generally flat vertical member 74*a* having a width substantially equal to the distance between the slits 72*e* and 72*f*. At the top of the member 74*a*, parallel tabs 74*b* and 74*c* extend from opposite side edges of the member 74*a* in a direction perpendicular thereto. The tabs 74*b* and 74*c* have a length greater than the width of the slide rail 72 and a width approximately two-thirds of the width of the member 74*a*. In certain embodiments, as illustrated in FIGS. 4 and 8, tabs 74*da* and 74*db* each extend generally from the midpoint of one edge of the vertical member 74*a* in a direction identical to that of the tabs 74*b* and 74*c*. Each tab 74*da* and 74*db* has a length approximately three-fourths of the width of the slide rail 72 and a width generally equal to that of the tabs 74*b* and 74*c*. In certain embodiments, as illustrated in FIGS. 6 and 9-13, only one tab 74*d*, in other words, 74*da* or 74*db*, can extend from the midpoint of the edge of the vertical member 74*a*.

Solitary tab 74*e*, located directly hereinafter the tab 74*b* and proximate the bottom of the vertical member 74*a*, extends in a direction identical to that of tabs 74*b*, 74*c* and 74*d* for a distance generally equal to the length of the tab 74*d*. The width of the tab 74*e* is generally equal to the width of the vertical member 74*a*. The tab 74*e* is configured to rest on the top face 40*f* of the PCB 40, when the slide rail support 74 is installed within the PCB 40.

In certain exemplary embodiments, the tab 74*e* can extend downward for a distance approximately equal to twice the thickness of the PCB 40, such that the tab 74*e* can be configured to engage a corresponding slot, not shown, in the PCB 40. The width of the vertical portion of the tab 74*e* can be generally equal to the width of the tabs 74*b*, 74*c*, and 74*d*, and/or the width of the horizontal portion of the tab 74*e*.

With reference to FIG. 8, solitary tab 74*f*, located adjacent to and at the same height as the tab 74*e*, is similar in size and length to and extends in a direction directly opposite that of the tab 74*d*. A tab 74*g*, as shown in FIG. 6, extends downward from the vertical member 74*a*, hereinafter the tabs 74*e* and 74*f*, for a distance approximately equal to twice the thickness of the PCB 40. In certain exemplary embodiments, the tab 74*g* can then extend back toward the tab 74*f* at about an angle of 45 degrees from the plane of the member 74*a*. The slide rail support 75 is substantially similar to the slide rail support 74 in structure and dimension and thus will not be described in detail.

The slider 76 includes a generally rectangular sleeve 76*a* sized to accept the slide rail 72. Two vertical panels 76*b* and 76*d* bound each side of the sleeve. The horizontal distance between the plane formed by the panel 76*b* and the plane formed by the panel 76*d* is generally equal to the width of the slide rail 72.

In certain exemplary embodiments, the sleeve 76*a* of slider 76 can include an offset panel configuration in which two spaced parallel vertical panels bound one side of the sleeve and the solitary third vertical panel 76*d* bounds the other side of the sleeve 76*a*. The solitary third vertical panel 76*d* can be oriented parallel to the panels on the other side of the sleeve 76*a* and be positioned directly opposite the space between the panels on the other side of the sleeve 76*a*.

The bottom edges of the vertical panels 76*b* and 76*d* are connected by a member 76*e* that bounds the bottom of the sleeve and includes a transverse horizontal slit 76*f* that extends all the way through the member. The length of the member 76*e* is generally equal to the distance between the distal bottom edges of the panels 76*b* and 76*d*. The top of the sleeve 76*a* is bounded by tabs 76*g* and 76*h*, which extend horizontally from and in a direction perpendicular to top edges of the panels 76*b* and 76*d*, and span the distance between the boundary defined by the panels 7*bd* and 76*d*. The length of each tab 76*g* and 76*h* is generally equal to the width of the panel 76*e*.

A pair of panels 76*i* and 76*j* extend upward from the inward edges of and in a direction perpendicular to the tabs 76*g* and 76*h*, respectively, for a distance generally equal to the height of the panels 76*b* and 76*d*. Two panels 76*k* and 76*l* are identical to the panels 76*i* and 76*j* in size, extend upward and parallel to the panels 76*i* and 76*j*, respectively, and are located generally between the panels 76*i* and 76*j* and the spring 80. Tab 76*m* spans the distance between the boundary defined by panel 76*i* and panel 76*k*. Tab 76*n* spans the distance between the boundary defined by panel 76*j* and panel 76*l*.

The exterior faces of the panels 76*i* and 76*j* feature snap-fit protrusions 76*ia* and 76*ja*, respectively, which jut outward for a short distance in a direction generally perpendicular to the panels. The protrusions 76*ia* and 76*ja* then extend upward and back toward the top edges of the panels 76*i* and 76*j*, respectively. The top portion of the protrusions 76*ia* and 76*ja* meet the panels 76*i* and 76*j*, respectively, just hereinafter the top of the panels. A panel 76*o* extends between the top edges of panels 76*i* and 76*j* and has the same width as and is connected to the panels 76*k-l*.

The configuration described above defines a space 76*p* bounded by the panels 76*k* and 76*l* on the sides and the panel 76*o* on top. On the side of the slider 76 that bears the panel 76*b*, a tab 76*q* is connected to the edges of panels 76*k*, 76*o*, and 76*b* and extends generally halfway across the distance separating the panel 76*k* and the panel 76*l*, further enclosing the space 76*p*.

On the opposite side of the slider 76 from the tab 76*q*, located adjacent to the panel 76*d*, a vertical panel 76*r* covers the framework created by the tabs 76*h* and 76*n* and the panels 76*j*, 76*l*, and 76*o* and further encloses the space 76*p*. The top edge of the panel 76*r* is connected to and follows the profile of the edge of the horizontal panel 76*o*. The bottom edge of the panel 76*r* is connected to the outer edge of the tab 76*n* and to the upper edge of the panel 76*d*. The vertical edge of the panel 76*r* that is proximate the space between the panels 76*k* and 76*l* extends from the panel 76*o*, beginning generally halfway between the panels 76*k* and 76*l*, and extends downward to the top edge of the panel 76*d*. The vertical edge of the panel 76*r* that is distal to the space between the panels 76*k* and 76*l* follows the profile of the protrusion 76*ja* until the protrusion reaches the point at which it is furthest from the panel 76*j*. The distal edge of the panel 76*r* then extends away from the panel 76*j* a short distance and then extends downward at a steep angle to meet the tab 76*h*.

A panel 76*s* is located on the same side of the slider 76 as the panel 76*r* and mirrors the panel 76*r*—with the exception that the panel 76*s* does not cover any part of the opening defined by the panels 76*d*, 76*k*, 76*l*, and 76*o*—and covers the framework defined by the tab 76*m* and the panels 76*k*, 76*i*, and 76*o*. The top edge of the panel 76*s* is connected to and follows the profile of the edge of the horizontal panel 76*o*. The bottom edge of the panel 76*s* is connected to the outer edge of the tab 76*m* and to the upper edge of the panel 76*d*. The vertical edge of the panel 76*s* that is proximate the space between the panels 76*k* and 76*l* extends from the panel 76*o* and follows the edge of the panel 76*k* downward to the top edge of the panel 76*d*. The vertical edge of the panel 76*s* that is distal to the space between the panels 76*k* and 76*l* follows the profile of the protrusion 76*i* a until the protrusion reaches the point at which it is furthest from the panel 76*i*. The distal edge of the panel 76*s* then extends away from the panel 76*i* a short distance and then extends downward at a steep angle to meet the tab 76*g*.

Tabs 76*t*, 76*u*, and 76*v* are aligned along planes parallel to those of the panels 76*b* and 76*d* and extend upward from and in a direction perpendicular to the top face of the panel 76*o*. The tab 76*t* is located halfway between the ends of the panel 76*o* and is slightly offset from the center of the face of the panel in the direction of the panel 76*b*. The tab 76*t* has a substantially square profile when viewed from an angle perpendicular to the plane of the tab's face and a height equal to approximately one-fifth the length of the panel 76*o*.

The tabs 76*u* and 76*v* are located at the corners of the panel 76*o* opposite the tab 76*t* and above the panels 76*r* and 76*s*, respectively. The tabs 76*u* and 76*v* have substantially rectangular profiles when viewed from an angle perpendicular to the planes of the tabs' faces and heights equal to approximately one-fifth the length of the panel 76*o*. The width of the tabs 76*u* and 76*v* is approximately two-fifths the length of the panel 76*o*.

Vertical tab 76*w* extends outward and upward from protrusion 76*ia* and is aligned with and coplanar with tab 76*u*. The tab 76*w* extends vertically from the protrusion 76*ia* in a direction parallel to the panel 76*j* and rises to a height substantially equal to that of the tab 76*t*. The tab 76*w* extends outward from the protrusion 76*ia* at an upward angle for a distance substantially equal to the length of the tabs 76*u* and 76*v*, then makes a 90-degree turn and extends laterally until it is substantially even with the tabs 76*u* and 76*v*.

Horizontal tab 76*x* extends, at a 90-degree angle, from the top edge of the tab 76*w* in a direction opposite the tabs 76*u* and 76*v*. The top face of the tab 76*x* is the same size as or slightly larger than the face of the tabs 76*u* and 76*v*.

Vertical tab 76*y* and horizontal tab 76*z* are substantially identical to the vertical tab 76*x* and the horizontal tab 76*y* with respect to relative placement on the protrusion 76*ja* and therefore will not be described in detail.

With reference to FIG. 6, the slider connector 78 is composed of an electrically conductive material, has some degree of flexibility, and includes a generally flat connector body 78*a* that is substantially the same width as the slide rail 72. Tab 78*b* extends from the midpoint of the side of the connector body 78*a* and has a width that is slightly larger than the width of the connector body 78. The tab 78*b* extends horizontally for a short distance in a direction perpendicular to the main body 78*a*. The tab 78*b* then extends upward at a 90-degree angle for a distance substantially similar to the distance between the bottom of the member 76*e* of the slider 76 and the slit 76*f* of the slider 76. The tab 78*b* then extends horizontally in the direction of the connector body 78*a* so that the tab 78*b* overhangs the connector body 78*a* by an equal amount on both sides. The free end 78*ba* of the tab 78*b* broadens to a width substantially similar to that of the slit 76*f*. In certain exemplary embodiments, the free end 78*ba* includes dimples 78*bb*, which extend downward from the free end 78*ba* toward the main connector body 78*a*, to provide a better interference fit when the tab 78*b* is inserted into the slit 76*f*.

The slider connector 78 further includes slider contacts 78*c* and 78*d*, which extend continuously from opposite ends of the connector body 78*a*. The slider contacts 78*c* and 78*d* extend in an arcuate path that initially dips downward, hereinafter the plane of the connector body 78*a*, then curve upward and terminates at a point substantially level with the plane of the connector body 78*a*. The distance between the lowest points of the undersides of the slider contacts 78*c* and 78*d* is substantially similar to the distance between the centerpoints of the stationary contacts 60 and 64, 62 and 66, and 64 and 68.

The ball 82 that is included in the slider assembly 70 is a sphere with a diameter slightly smaller than both the length of the distance between the panels 76*k* and 76*l* of the slider 76 and the length of the distance between the tab 76*q* and the panel 76*r* of the slider 76. The spring 80 is a coil spring having a diameter that is at least slightly smaller than that of the ball 82, such that the ball 82 cannot be inserted into the interior space defined by the coils of the spring 80. The free length of the spring 80 is at least longer than the difference between the vertical distance from the bottom face of tab 76*g* to the panel 76*o* and the diameter of the ball 82. The compressed height of the spring 80 is no longer than the difference in length just described.

In an exemplary embodiment, when the slide rail 72, the slide rail supports 74 and 75, the slider 76, the slide connector 78, the spring 80, and the ball 82 are in an assembled condition, as illustrated in FIGS. 3-10, the spring 80 is inserted lengthwise into the space 76*p*, followed by the ball 82. During assembly, an external force is applied to ensure that the ball 82 is forced far enough into the space 76*p* so that no part of the ball 82 extends into the rectangular sleeve 76*a*.

The slide rail 72 is inserted into the rectangular sleeve 76*a* and is oriented so that the surface 72*a*, which bears the detents 72*b*, 72*c*, and 72*d*, is facing upward. When the slide rail 72 is inserted into the rectangular sleeve 76*a* and the external force holding the ball 82 within the space 76*p* is removed, the ball 82 rests on either the surface 72*a* or in one of the detents 72*b*, 72*c*, and 72*d*, depending on which section of the slide rail 72 is directly under the space 76*p* when the ball 82 is released.

The slider connector 78 is coupled to the slider 76 by inserting the tab 78*b* into the slit 76*f*, from the side of the slider 76 bearing the panel 76*d*, so that the connector body 78*a* is slung beneath the member 76*e*. The slide rail 72 is then coupled with the slide rail supports 74 and 75. The tabs 74*b* and 74*c* are inserted into the slits 72*e* and 72*f*, respectively, and the tabs 75*b* and 75*c* are inserted into the slits 72*g* and 72*h*, respectively. The tabs 74*b* and 74*c* are bent toward each other, as are the tabs 75*b* and 75*c*. The slide rail 72 generally rests on tabs 74*d* and 75*d*.

The slider assembly 70 is coupled to the PCB 40 by inserting the tabs 74*g* and 75*g* into slits 40*b* and 40*c* so that the lower end of the members 74*a* and 75*a* are substantially flush with the front face 40*f*. The portions of the tabs 74*g* and 75*g* that protrude beyond rear face 40*g* are then bent 45 degrees about the longitudinal axes of the vertical members 74*a* while the members 74*a* and 75*a* remain static. The portions of the tabs 74*g* and 75*g* that protrude beyond the rear face 40*g* are soldered or otherwise secured to the rear face 40*g*.

In an exemplary embodiment, when the slider assembly 70 is installed on the PCB 40, as illustrated in FIGS. 4 and 9-13, the slider connector 78 is disposed above and aligned with the array of the stationary contacts 60, 62, 64, 66 and 68. The slider connector 78 is disposed at a height above the array such that when one of the slider contacts 78*c* and 78*d* is in-between two adjacent stationary contacts, the lowest point of the slider contact 78*c* or 78*d* extends hereinafter the highest point of the stationary contacts. When the lowest point of the curve of each of the slider contacts 78*c* and 78*d* is in contact with the centerpoint of one of the stationary contacts 60, 62, 64, 66, and 68, the connector body 78*a* flexes to accommodate the difference in the components' heights and thus biases the slider contacts 78*c* and 78*d* against their respective stationary contacts.

Figure 9:
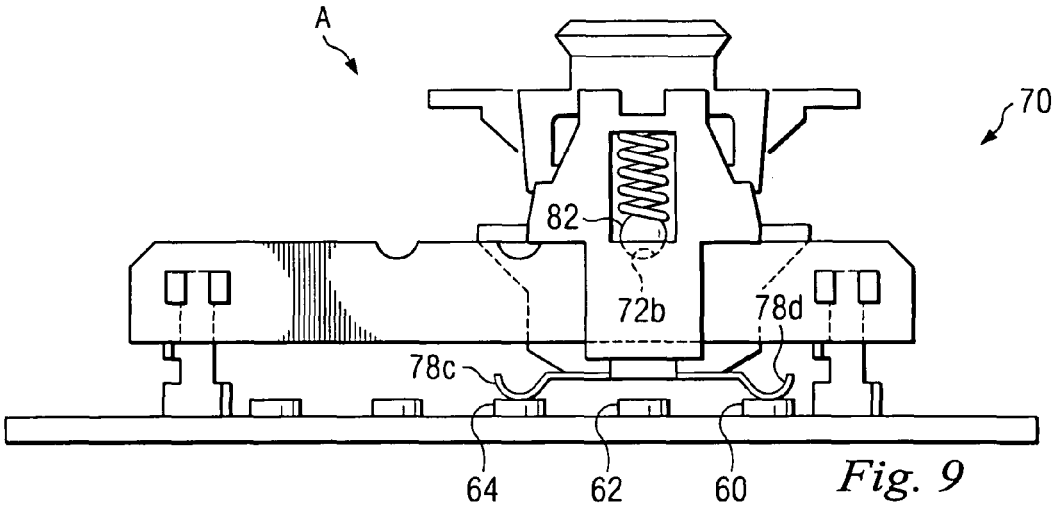
FIG. 9 is an elevational view of an exemplary slider assembly of an exemplary electrical control device at a first engaged control position, in accordance with certain exemplary embodiments.
Figure 10:
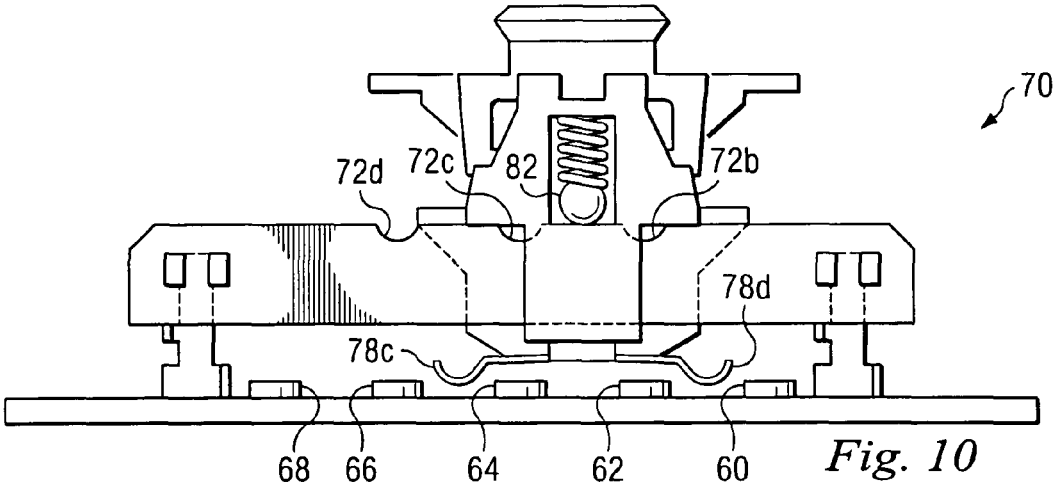
FIG. 10 is an elevational view of an exemplary slider assembly of an exemplary electrical control device at a first disengaged control position, in accordance with certain exemplary embodiments.
Figure 11:
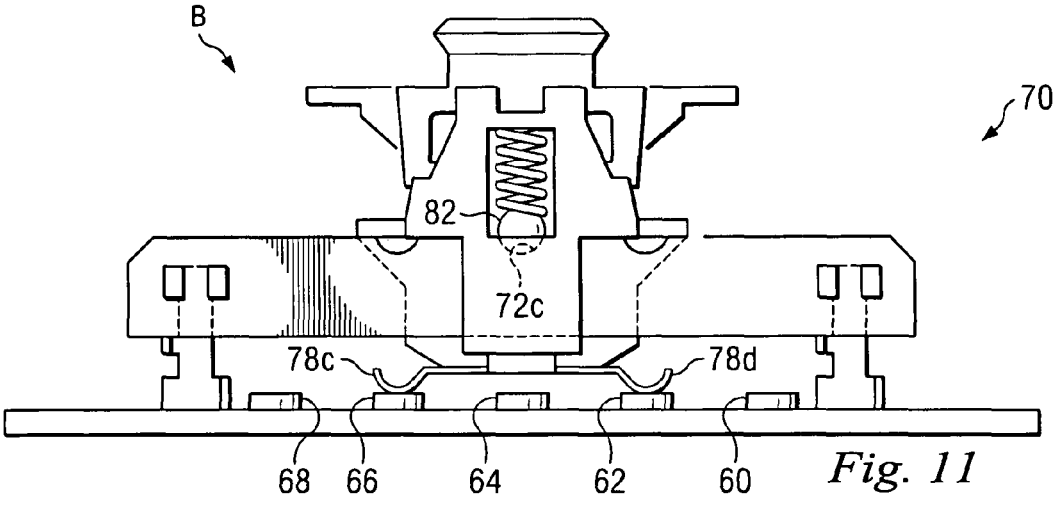
FIG. 11 is an elevational view of an exemplary slider assembly of an exemplary electrical control device at a second engaged control position, in accordance with certain exemplary embodiments.
Figure 12:
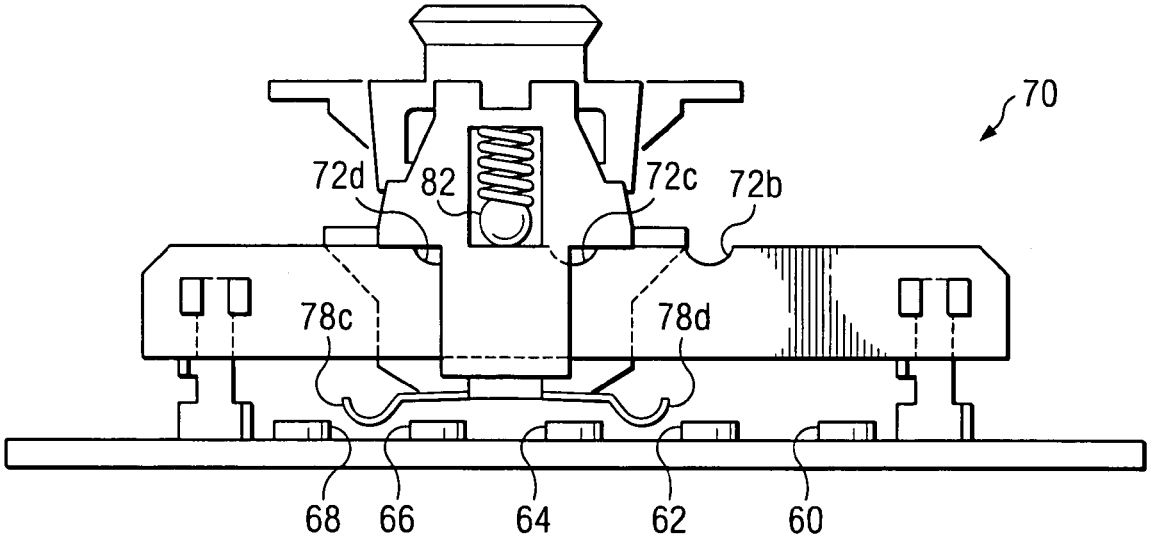
FIG. 12 is an elevational view of an exemplary slider assembly of an exemplary electrical control device at a second disengaged control position, in accordance with certain exemplary embodiments.
Figure 13:
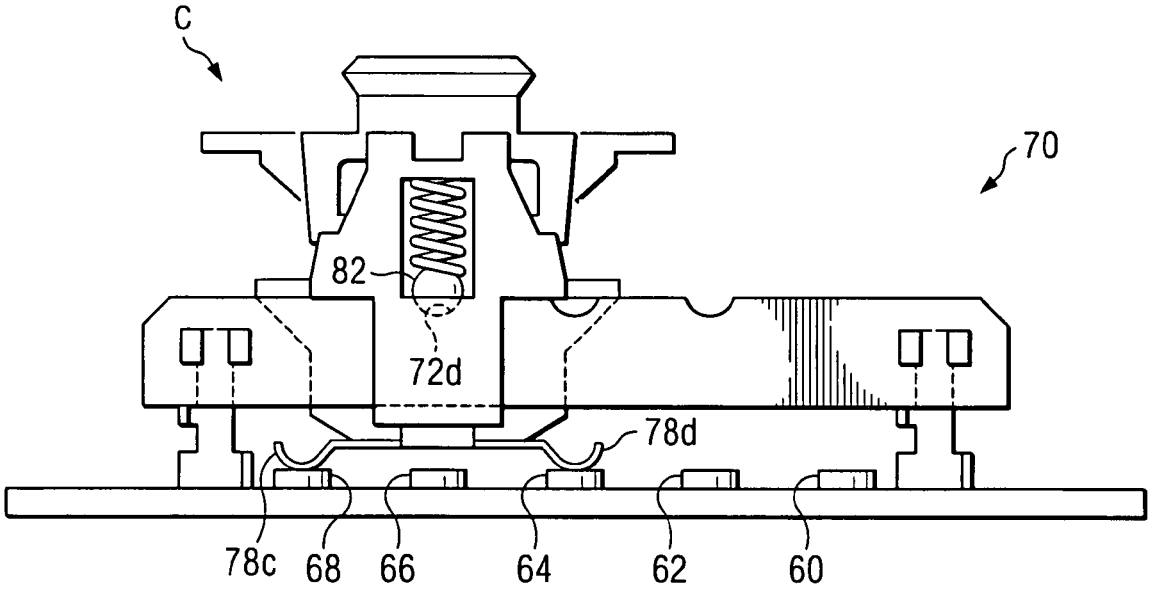
FIG. 13 is an elevational view of an exemplary slider assembly of an exemplary electrical control device at a third engaged control position, in accordance with certain exemplary embodiments.
Figure 14:
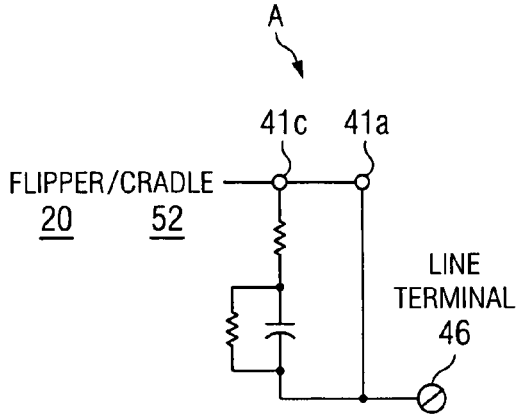
FIG. 14 is a circuit diagram illustrating an exemplary circuit of an exemplary first configuration of an electrical control device, in accordance with certain exemplary embodiments.
Figure 15:
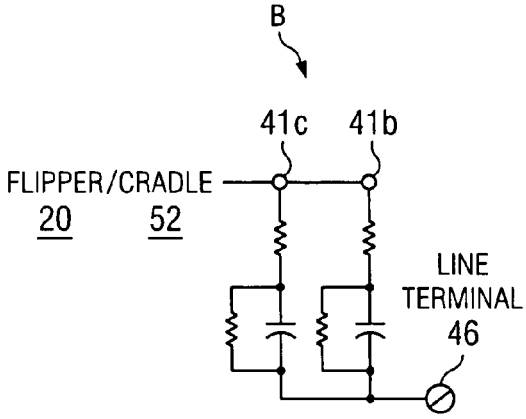
FIG. 15 is a circuit diagram illustrating an exemplary circuit of an exemplary second configuration of an electrical control device, in accordance with certain exemplary embodiments.

FIGS. 9-13 depict elevational views of the slider 76 at engaged and disengaged control positions, in accordance with certain exemplary embodiments. FIGS. 9, 11, and 13 depict the slider 76 at engaged control positions and FIGS. 10 and 12 depict the slider 76 at disengaged control positions.

In certain embodiments, each control position can correspond to a different setting of a device controlled by the electrical device 10. For example, each control position can correspond to a speed setting of one or more fans controlled by the electrical device 10. By way of example only, the first engaged control position can correspond to a low speed setting, the second engaged control position can correspond to an intermediate speed setting, and the third engaged control position can correspond to a high speed setting. Alternatively, the first engaged control position can correspond to a high speed setting, the second engaged control position can correspond to an intermediate speed setting, and the third engaged control position can correspond to a low speed setting. Other appropriate setting allocations will be apparent to a person of skill in the art having the benefit of the present disclosure.

The control positions of the slider 76 are defined by the location of the ball 82 along the slide rail 72 and the corresponding locations of the slider contacts 78*c* and 78*d* with respect to the stationary contacts 60, 62, 64, 66 and 68. As illustrated in FIG. 9, the slider 76 is in a first engaged control position, position "A" when the ball 82 is cradled by the detent 72*b* and the slider contacts 78*c* and 78*d* are biased against the tops of the stationary contacts 60 and 64, respectively. As illustrated in FIG. 11, the slider 76 is in a second engaged control position, position "B," when the ball 82 is cradled by the detent 72*c* and the slider contacts 78*c* and 78*d* are biased against the tops of the stationary contacts 62 and 66, respectively. As illustrated in FIG. 13, the slider 76 is in a third engaged control position, position "C," when the ball 82 is cradled by the detent 72*d* and the slider contacts 78*c* and 78*d* are biased against the tops of the stationary contacts 64 and 68, respectively. In each engaged control position, the slide connector 78 straddles one of the stationary contacts 60, 62, 64, 66, and 68 and the lowest points of the slide contacts 78*c* and 78*d* are generally in contact with the peaks of the stationary contacts adjacent to the one straddled by the slide connector 78.

If the slider 76 is positioned so that the ball 82 rests on the surface 72*a* exactly midway between the detents 72*b* and 72*c*, as shown in FIG. 10, or the detents 72*c* and 72*d*, as shown in FIG. 12, the slide connector 78 is in a disengaged control position, straddling two of the stationary contacts 60, 62, 64, 66, and 68. The lowest point of each of the slide contacts 78*c* and 78*d* extends lower than the peak of any of the stationary contacts 60, 62, 64, 66, and 68.

If the slider 76 is positioned so that the ball 82 rests neither halfway between the detents 72*b* and 72*c* or 72*c* and 72*d* nor in any of the detents themselves, then, depending on the dimensions of the slider connector 78, several scenarios are possible. One of the slide contacts 78*c* and 78*d* may contact the outer edge of one of the stationary contacts 60, 62, 64, 66, and 68 while the other of the slide contacts 78*c* and 78*d* does not contact its corresponding stationary contact. Both of the slide contacts 78*c* and 78*d* may contact the outer edge of one of their corresponding stationary contacts 60, 62, 64, 66, and 68. Or, neither of the slide contacts 78*c* and 78*d* will contact any of the stationary contacts 60, 62, 64, 66, and 68.

Although the disclosure herein only describes three engaged control positions and two disengaged control positions, a person of ordinary skill will recognize that any number of engaged control positions could be used without departing from the spirit and scope of the invention.

Referring to FIGS. 1 and 2, the switch housing assembly 18 includes a switch housing 90, a generally rectangular box sized to receive the printed circuit assembly 16 and the flipper 20. A ground terminal cutout 90*a* is located at the top of one end of the switch housing 90 and is offset slightly from the center of the switch housing 90. Counterbores 90*b* extend from the floor of the switch housing 90 into the interior space of the switch housing 90 at each of the four corners of the switch housing 90. Assembly sleeves 90*c* extend upward from counterbores 90*b* in a direction parallel to the sides of the switch housing 90 and are generally half the height of the sides of the switch housing 90.

The switch housing 90 also includes a contact receptacle 92, located on the floor of the switch housing 90, that is adapted to isolate the flipper 20 and the terminal contacts 48*a* and 50*a* from the other components of the printed circuit assembly 16 when the device 10 is in an assembled condition.

The switch housing 90 also includes, on the floor of the switch housing 90 at the end that is opposite the ground terminal cutout 90*a*, a line terminal compartment 94 that includes an opening 94*a* through which the line terminal compartment 94 is accessible from the exterior of the switch housing 90. A tab 94*b* extends a short distance from the bottom center of the opening 94*a* and is substantially coplanar with the side of the switch housing. The line terminal compartment 94 is wide enough to receive the line terminal 46 and deep enough to receive both the line terminal 46 and the line terminal lug 102. The line terminal lug 102 includes a generally square-shaped contact 102*a* which is threadably engaged with a short screw 102*b*, which extends through the center the contact 102*a*.

Load terminal compartments 98 and 100 are located on the left side of the switch housing 90, one on either side of the contact receptacle 92, and, similar to the line terminal compartment 94, feature openings 98*a* and 100*a* through which the load terminal compartments 98 and 100, respectively, are accessible from the exterior of the switch housing 90. The load terminal compartments 98 and 100 also include tabs 98*b* and 100*b*, respectively, which are substantially similar in design and placement to the tab 94*b*. The load terminal compartments 98 and 100 are wide enough to receive the load terminals 48 and 50, respectively, and deep enough to receive both the load terminals 48 and 50, respectively, as well as the load terminal lugs 104 and 106, respectively. The load terminal lugs 104 and 106 include generally square-shaped contacts 104*a* and 106*a*, respectively, which are threadably engaged with short screws 104*b* and 106*b*, respectively, which extend through the center the contacts 104*a* and 106*a*, respectively. Assembly screws 108 have a diameter slightly smaller than that of the assembly sleeves 90*c* and a length generally one-and-a-half times that of the assembly sleeves 90*c*.

In an exemplary embodiment, when the components of the switch housing assembly 18 are in an assembled condition, as illustrated in FIG. 1, with continuing reference to FIG. 2, the contacts 102*a*, 104*a*, and 106*a* are disposed in the line terminal compartment 94 and the load terminal compartments 98 and 100, respectively. The screws 102*b*, 104*b*, and 106*b* rest on top of the tabs 94*b*, 98*b*, and 100*b*, respectively, and remain exposed on the outside of the terminal compartments 94, 98, and 100, respectively. The assembly screws 108 extend through the counterbores 90*b* and the assembly sleeves 90*c*.

When the actuator assembly 12, the mounting plate 14, the printed circuit assembly 16, and the switch housing assembly 18 are in an assembled condition, as illustrated in FIG. 1, the assembly protrusions 28*f* and assembly tabs 28*h* of the actuator mount 28 extend through the assembly pass-throughs 14*e* and the assembly tab pass-throughs 14*i* of the mounting plate 14, respectively. The flipper 20, the actuator 22, and the actuator spring 24, all in an assembled condition and seated in the actuator receptacle 26*f*, pass through the actuator pass-through 14*f* of the mounting plate 14.

The printed circuit assembly 16 is aligned so that, as the printed circuit assembly 16 is received by the actuator assembly 12, the actuator pass-through 40*a* and the flipper cradle 52 of the printed circuit assembly 16 receive the flipper 20. The slider 76 aligns with the slider pass-through 14*g*, the slot 30*a*, and the knob slot 28*e* of the actuator mount 28. The assembly notches 40*e* receive the assembly tabs 28*h* and the tab heads 28*h* a snap into place on the rear face 40*g*, generally restricting the printed circuit assembly 16 from moving relative to the actuator assembly 12 and the mounting plate 14. The ends of the assembly protrusions 28*f* rest on the front face 40*f*, further restricting movement of the printed circuit assembly 16, and interiors of the assembly protrusions 28*f* align with the assembly pass-throughs 40*d*.

The selector knob 32 is received by the slider 76 and the connection members 32*c* extend down the sides of the panels 76*i* and 76*j*. The protrusions 32*d* form a snap-fit with the snap-fit protrusions 76*ia* and 76*ja*. The bottom of crosspiece 32*b* rests flat on the panel 76*o* and is flanked by the tabs 76*t*, 76*u*, 76*v*, 76*w*, and 76*x*, which restrict movement of, and provide support for, the knob 32. The crosspiece 32*b* is also restrained from moving along the knob slot 28*e* independently of the slider 76 by the tabs 76*y* and 76*z*.

The actuator assembly 12, the mounting plate 14, and the printed circuit assembly 16 are received by the switch housing assembly 18. More particularly, the contact receptacle 92 receives the flipper 20 and the terminal contacts 48*a* and 50*a*. The line terminal compartment 94 and the load terminal compartments 98 and 100 receive the line terminal 46 and the load terminals 48 and 50, respectively. The spaced members 46*a* and 46*b* of the line terminal 46 straddle the screw 102*b* and are disposed in front of the contact 102*a* so that the line terminal 46 is exposed to the exterior of the switch housing 90. The spaced members 48*a* and 48*b* and 50*a* and 50*b* of the load terminals 48 and 50, respectively, straddle the screws 104*b* and 106*b*, respectively, and are disposed in front of the contacts 104*a* and 106*a*, respectively, so that the load terminals 48 and 50 are exposed to the exterior of the switch housing 90.

The ground terminal cutout 90*a* receives the ground terminal 14*h*. When the device 10 is properly assembled, the top edge 90*d* of the switch housing 90 is flush with the mounting plate 14. The assembly screws 108 extend through the assembly sleeves 90*c* to engage the assembly protrusions 28*e* and are tightened so that the heads of the assembly screws 108 are sunk entirely into the counterbores 90*b*.

In its assembled condition, the device 10 is in either an "engaged" state or a "disengaged" state. In the disengaged state, as illustrated in FIG. 1, a rocker end 26*ha* is depressed into the recess 28*b* so that the flipper 20 is actuated and the flipper contact 20*a* is biased against the terminal contact 48*a*. The device circuit 41 electrically couples the line terminal 46 and the load terminal 48. In the engaged state, the rocker end 26*hb* is depressed into the recess 28*b* so that the flipper 20 is actuated and the flipper contact 20*a* is biased against the terminal contact 50*a*. The device circuit 41 electrically couples the line terminal 46 and the load terminal 50. The state of the device 10 determines whether and how voltage travels into or out of the device 10, as described herein.

The path taken by any voltage that travels through the device 10 is determined by the configuration of the device circuit 41, a characteristic determined independently of the state of the device 10. The configuration of the device circuit 41 is determined independently of the engaged or disengaged state of the device 10 because the state of the device 10—more specifically, the position of the flipper 20 and flipper contact 20*a*—does not affect the path voltage takes between the flipper cradle 52 and the line terminal 46. The device circuit 41 can be configured by adjusting the position of the slider 76 along the slide rail 72. Three discrete engaged control positions of the slider 76, and corresponding positions of the slider connector 78 and the slider contacts 78*c* and 78*d*, determine three corresponding discrete configurations of the device circuit 41.

When the slider 76 is in position A, as illustrated in FIGS. 1, 4, and 9, the slider 76 is positioned so that the ball 82 is cradled in the detent 72*b* and the slider contacts 78*c* and 78*d* are biased against the centerpoints of the stationary contacts 60 and 64, respectively. The position A of the slider 76 corresponds to a configuration A of the device circuit 41, illustrated in FIG. 14, in which the circuit pathways 41*a* and 41*c* are electrically coupled in parallel and constitute the only pathways by which voltage may pass between the line terminal 46 and the flipper cradle 52.

When the slider 76 is in a position B, as illustrated in FIG. 11, the slider 76 is positioned so that the ball 82 is cradled in the detent 72*c* and the slider contacts 78*c* and 78*d* are biased against the centerpoints of the stationary contacts 62 and 66, respectively. The position B of the slider 76 corresponds to a configuration B of the device circuit 41, illustrated in FIG. 15, in which the circuit pathways 41*b* and 41*c* are electrically coupled in parallel and constitute the only pathways by which voltage may pass between the line terminal 46 and the flipper cradle 52.

When the slider 76 is in a position C, as illustrated in FIG. 13, the slider 76 is positioned so that the ball 82 is cradled in the detent 72*d* and the slider contacts 78*c* and 78*d* are biased against the centerpoints of the stationary contacts 64 and 68, respectively. The position C of the slider 76 corresponds to a configuration C of the device circuit 41, illustrated in FIG. 16, in which the circuit pathway 41*c* constitutes the only pathway by which voltage may pass between the line terminal 46 and the flipper cradle 52.

In certain exemplary embodiments, such as that illustrated in FIGS. 9-13, operation of the device 10 includes manipulating the selector knob 32 to move the slider 76 between the three positions A, B and C and reconfigure the device circuit 41 as previously described. In the absence of a force other than those exerted by components of the device 10, the slider 76 does not move with respect to the slide rail 72. As illustrated in FIG. 9, when the ball 82 is resting in the detent 72*b*, the spring 80 is partially compressed and exerts a downward force on the ball 82 that prevents the ball 82 from moving away from the slide rail 72 and out of the detent 72*b*. The curved sidewalls of the detent 72*b* exert a lateral force in opposition of any lateral movement of the ball 82 and prevent the ball 82 from moving along the surface 72*a*. Movement of the slider 76 along the slide rail 72 is similarly restricted by contact between the panels 76*k* and 76*l*, illustrated more clearly in FIG. 4, and the ball 82.

The position of the slider 76, and thus the configuration of the device circuit 41, is adjusted by applying a force, not shown, to the selector knob 32, at the head 32*a*, in the direction in which the slider 76 is to be moved. The force is transferred from the selector knob 32 to the slider 76 through the crosspiece 32*b* and the members 32*c*. The slider 76 transfers the force to the ball 82 via one of the panels 76*k* or 76*l*.

FIGS. 9-13 illustrate certain exemplary embodiments in which the slider 76 is moved from position A, as shown in FIG. 9, to position B, as shown in FIG. 11, to position C, as shown in FIG. 13. To go from position A to position B, a force can be applied to the selector knob 32 in FIG. 9 in the direction of the slide rail support 75. The force is transferred to the ball 82 by the panel 76*k*. The curved sidewall of the detent 72*b* opposes the force and, if the force is of sufficient magnitude to move the slider 76 and the ball 82 along the slide rail 72, exerts an upward force that overcomes the downward force exerted by the spring 80 to cam the ball 82 upward and out of the detent 72*b*. The upward movement of the ball 82 compresses the spring 80. The movement of the slider out of position A breaks the electrical coupling of slider contacts 78*c* and 78*d* with the stationary contacts 60 and 64, respectively.

Figure 16:
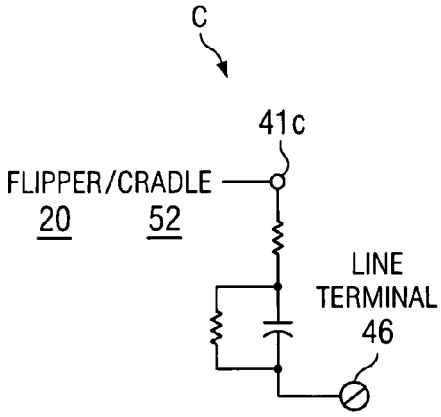
FIG. 16 is a circuit diagram illustrating an exemplary circuit of an exemplary third configuration of an electrical control device, in accordance with certain exemplary embodiments.

As illustrated in FIG. 10, when the slider 76 is positioned so that the ball 82 is generally halfway between the detents 72*b* and 72*c*, the slider contacts 78*c* and 78*d* do not contact any of the stationary contacts 60, 62, 64, 66 and 68, and the device circuit 41 functionally resembles the circuit diagram illustrated in FIG. 16.

When the force is applied continuously so that the slider 76 and the ball 82 traverse the distance between the detent 72*b* and the detent 72*c*, the ball 82 is pressed into the detent 72*c* by the released spring 80 and the slider 76 enters the position B, as shown in FIG. 11. The slider contacts 78*c* and 78*d* are electrically coupled with the stationary contacts 62 and 66, and the device circuit 41 resembles the diagram shown in FIG. 15. If the force is not removed when the slider 76 enters the position B, the ball 82 is forced out of the detent 72*c*, as described previously with respect to the detent 72*b*, and the ball 82 and the slider 76 continue to move along the slide rail 72. The movement of the ball 82 and the slider 76 between the detents 72*c* and 72*d*, as well as the entry of the slider 76 into and out of the position C, are substantially similar to the mechanics described above with respect to the positions A and B and therefore will not be described in detail. The movement of the ball 82 and the slider 76 along the slide rail 72 is restricted by the interaction of the slider 76 with the slide rail supports 74 and 75.

Figure 17:
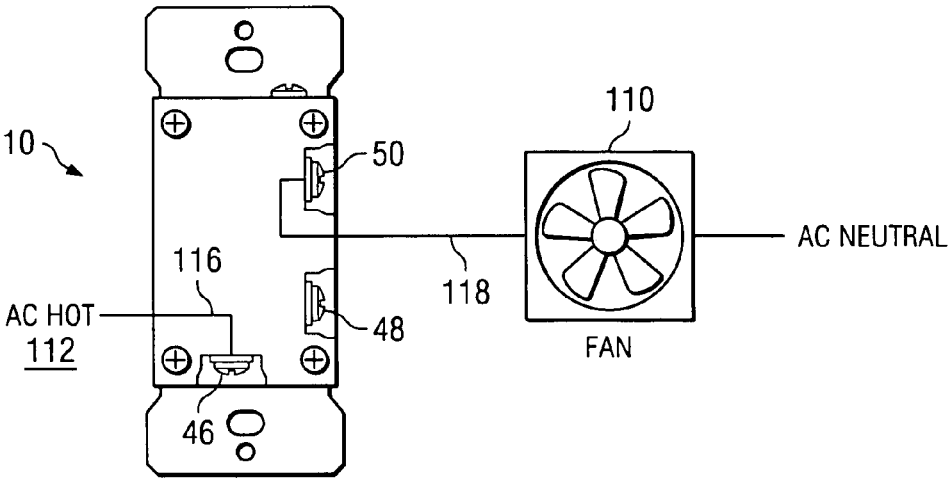
FIG. 17 is a schematic diagram of an exemplary fan motor circuit, in accordance with certain exemplary embodiments.

In the operation of an exemplary embodiment, as illustrated in FIG. 17, the device 10 is installed in a motor circuit of a fan 110 and electrically coupled to a power source 112 that supplies voltage to a motor, not shown, of the fan 110. The device 10 is electrically coupled to the power source 112 by a line 116 running between the power source 112 and the line terminal 46. The device 10 is also electrically coupled to the fan motor by a line 118 running between the load terminal 50 and the fan 110.

When the device 10 is in an assembled condition, the line terminal 46 is electrically coupled to one of the load terminals 48 and 50, depending on whether the device 10 is in its engaged or disengaged state. When the device 10 is in its disengaged state, as illustrated in FIGS. 1, 2 and 4, the line terminal 46 is electronically coupled to load terminal 48. When the device 10 is in its engaged state, the line terminal 46 is electronically coupled to load terminal 50, which is electronically coupled to the motor of the fan 110.

A person of ordinary skill in the art, having the benefit of the present disclosure, will recognize that alternative suitable configurations exist. For example, the device 10 can be connected in a 3-way wiring arrangement, with an on/off control in two different locations and a fan speed control in one of the two locations.

In an exemplary embodiment, the exemplary circuit 41 illustrated in FIG. 7 can be a capacitive type of fan speed control in which capacitors are inserted in series with a fan motor to introduce a voltage drop dependent on the speed setting. The reduced voltage available to the fan motor can result in speed reduction. A selector switch can reconfigure the circuitry for each speed selected. In the exemplary device circuit 41 depicted in FIG. 7, a resistor R1 is in series with a capacitor C1, and a resistor R3 is in series with a capacitor C2. The resistors R1 and R3 and capacitors C1 and C2 serve to minimize switch contact arcing when a selector switch S1 is moved from one position to another. For example, each of the resistors R1 and R3 can have a resistance of 3 Ohms. For example, each of the capacitors C1 and C2 can have 4μ7 200V capacitance.

Resistors R2 and R4 are in parallel with the capacitors C1 and C2, respectively. These resistors R2 and R4 serve as "bleeder" resistors for the capacitors C1 and C2 to remove any residual voltage on the capacitors when the device 10 is in an off position. For example, the resistors R2 and R4 can minimize a possible shock hazard resulting from any voltage charge left on the capacitors C1 and C2. For example, each of the resistors R2 and R4 can have a 330 k ¼ W resistance.

In conclusion, the foregoing exemplary embodiments enable an electrical control device. Many other modifications, features, and embodiments will become evident to a person of ordinary skill in the art having the benefit of the present disclosure. It should be appreciated, therefore, that many aspects of the invention were described above by way of example only and are not intended as required or essential elements of the invention unless explicitly stated otherwise. Accordingly, it should be understood that the foregoing relates only to certain embodiments and that numerous changes can be made therein without departing from the spirit and scope of the invention as defined by the following claims. It should also be understood that the invention is not restricted to the illustrated embodiments and that various modifications can be made within the scope of the following claims.

We claim:

1. An electrical control device, comprising:

an elongated member comprising a plurality of substantially collinear detents on a first side thereof, the detents being disposed along a longitudinal axis of the first side of the elongated member;

a slider coupled to the elongated member and slidable along the longitudinal axis of the elongated member;

a knob coupled to a first side of the slider;

a positioning member coupled to a second side of the slider, the second side of the slider disposed opposite the first side of the slider, the positioning member engaging the first side of the elongated member and positionable along the first side of the elongated member in conjunction with the slider;

a spring disposed substantially between the positioning member and the second side of the slider;

a connector coupled to the second side of the slider and comprising at least one contact that engages a stationary contact of a printed circuit board when the positioning member is at least partially disposed within one of the detents of the elongated member, wherein an axis parallel to an axis of compression of the spring intersects each of the slider, the knob, and the positioning member.

2. The electrical control device of claim 1, wherein the positioning member comprises a spherical member.

3. The electrical control device of claim 2, wherein the spring has a diameter that is smaller than a diameter of the spherical member.

4. The electrical control device of claim 1, wherein the first side comprises a top edge disposed along a length of the elongated member.

5. The electrical control device of claim 1, wherein the connector comprises two contacts and the printed circuit board comprises at least two stationary contacts, and wherein each of the contacts of the connector engages a corresponding one of the stationary contacts of the printed circuit board when the positioning member is at least partially disposed within one of the detents of the elongated member.

6. The electrical control device of claim 5, further comprising the printed circuit board comprising three substantially collinear, stationary contacts, a first of the stationary contacts being disposed between a second of the stationary contacts and a third of the stationary contacts, and wherein, when the positioning member is at least partially disposed within one of the detents of the elongated member, one of the contacts of the connector engages the second stationary contact, the other of the contacts of the connector engages the third stationary contact, and neither of the contacts of the connector engages the first stationary contact.

7. The electrical control device of claim 1, wherein the contact of the connector does not engage the stationary contact of the printed circuit board when the positioning member is disposed between two of the detents.

8. The electrical control device of claim 1, further comprising a spring disposed between the slider and the connector.

9. The electrical control device of claim 1, wherein the electrical control device controls a speed setting of a fan.

10. The electrical control device of claim 9, wherein the printed circuit board comprises at least two stationary contacts, each of the stationary contacts corresponding to a different speed setting of the fan.

11. The electrical control device of claim 9, wherein the printed circuit board comprises at least two pairs of stationary contacts, each of the pairs of stationary contacts corresponding to a different speed setting of the fan, and wherein the connector engages at least one of the pairs of stationary contacts when the positioning member is at least partially disposed within one of the detents of the elongated member.

12. The electrical control device of claim 1, wherein the electrical control device comprises only one positioning member.

13. The electrical control device of claim 12, wherein one end of the spring directly contacts the second side of the slider, and another end of the spring directly contacts the positioning member.

14. The electrical control device of claim 1, wherein the axis of compression of the spring intersects each of the slider, the knob, and the positioning member.

15. An electrical control device, comprising:

an elongated member comprising a plurality of substantially collinear detents on a first side thereof, the detents being disposed along a longitudinal axis of the first side of the elongated member;

a slider coupled to the elongated member and slidable along the longitudinal axis of the elongated member;

a knob coupled to a first side of the slider;

a spherical member coupled to a second side of the slider, the second side of the slider disposed opposite the first side of the slider, the spherical member engaging the first side of the elongated member and slidable along first side of the elongated member in conjunction with the slider;

a spring disposed substantially between the spherical member and the second side of the slider and having a diameter that is smaller than a diameter of the spherical member, the spring exerting a force on the spherical member, toward the first side of the elongated member;

a printed circuit board comprising three substantially collinear, stationary contacts, a first of the stationary contacts being disposed between a second of the stationary contacts and a third of the stationary contacts; and a connector coupled to the second side of the slider and comprising two contacts, wherein, when the spherical member is at least partially disposed within one of the detents of the elongated member, one of the contacts of the connector engages the second stationary contact of the printed circuit board, the other of the contacts of the connector engages the third stationary contact of the printed circuit board, and neither of the contacts of the connector engages the first stationary contact of the printed circuit board, and wherein an axis of compression of the spring intersects each of the slider, the knob, and the positioning member.

16. The electrical control device of claim 15, wherein neither of the contacts of the connector engages one of the stationary contacts of the printed circuit board when the spherical member is disposed between two of the detents of the elongated member.

17. The electrical control device of claim 15, wherein the electrical control device controls a speed setting of a fan.

18. The electrical control device of claim 17, wherein the printed circuit board comprises at least two pairs of stationary contacts, each of the pairs of stationary contacts corresponding to a different speed setting of the fan.

19. The electrical control device of claim 15, wherein the electrical control device comprises only one spherical member.

20. The electrical control device of claim 19, wherein one end of the spring directly contacts the second side of the slider, and another end of the spring directly contacts the spherical member.

* * * * *